US011245981B2

(12) United States Patent
Awano et al.

(10) Patent No.: US 11,245,981 B2
(45) Date of Patent: Feb. 8, 2022

(54) SOUND COLLECTION AND PLAYBACK APPARATUS, AND RECORDING MEDIUM

(71) Applicant: MITSUBISHI ELECTRIC CORPORATION, Tokyo (JP)

(72) Inventors: Tomoharu Awano, Tokyo (JP); Masaru Kimura, Tokyo (JP); Satoru Furuta, Tokyo (JP); Jin Hirano, Tokyo (JP); Atsuyoshi Yano, Tokyo (JP); Nobuaki Tanaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/643,654

(22) PCT Filed: Nov. 15, 2017

(86) PCT No.: PCT/JP2017/041052
§ 371 (c)(1),
(2) Date: Mar. 2, 2020

(87) PCT Pub. No.: WO2019/097598
PCT Pub. Date: May 23, 2019

(65) Prior Publication Data
US 2020/0245064 A1 Jul. 30, 2020

(51) Int. Cl.
*H04R 1/40* (2006.01)
*G10K 11/34* (2006.01)
*H04R 3/00* (2006.01)

(52) U.S. Cl.
CPC ..... *H04R 1/406* (2013.01); *G10K 11/34* (2013.01); *H04R 3/005* (2013.01);
(Continued)

(58) Field of Classification Search
CPC ..... H04S 2420/11
See application file for complete search history.

(56) References Cited

U.S. PATENT DOCUMENTS

2008/0152154 A1 6/2008 Daishin et al.
2013/0177168 A1* 7/2013 Inha ..... H04N 21/4223 381/92
2016/0150336 A1* 5/2016 Silzle ..... H04R 29/002 381/59

FOREIGN PATENT DOCUMENTS

JP 5-260590 A 10/1993
JP 2002-232988 A 8/2002
(Continued)

OTHER PUBLICATIONS

Nishimura, "Ambisonics", The Journal of the Institute of Image Information and Television Engineers, 2014, vol. 68, No. 8, pp. 616-620.

(Continued)

*Primary Examiner* — Ping Lee
(74) *Attorney, Agent, or Firm* — Birch, Stewart, Kolasch & Birch, LLP

(57) ABSTRACT

A microphone array includes first and second microphones (Ma, Mb) placed on a first axis (f), a third microphone (Mc) placed on a plane (fg) formed by the first axis and a second axis (g) and at a position other than on the first axis, and a fourth microphone (Md) placed on a third axis (h), and at a position other than on the plane formed by the first and the second axes, and a processing circuit generates signals (Cx, Cy, Cz) having bidirectionality in first, second and third mutually perpendicular directions (x, y, z), and an omnidirectional signal (Cw), based on signals (Ba to Bd) obtained by sound collection by means of the first to fourth microphones. It is possible to generate signals having bidirectionality in mutually perpendicular directions, and an omnidirectional signal, without using special microphones, and without excessive restrictions with regard to the placement of the microphones.

13 Claims, 16 Drawing Sheets

(52) U.S. Cl.
CPC ..... *H04R 2430/20* (2013.01); *H04S 2400/15* (2013.01); *H04S 2420/11* (2013.01)

(56) References Cited

FOREIGN PATENT DOCUMENTS

| | | | |
|---|---|---|---|
| JP | 2008-154130 | A | 7/2008 |
| JP | 2008-160588 | A | 7/2008 |
| JP | 2012-4708 | A | 1/2012 |
| JP | 2018-120007 | A | 8/2018 |

OTHER PUBLICATIONS

Van Veen et al., "Beamforming: A versatile Approach to Spatial Filtering" IEEE ASSP Magazine, Apr. 1988, total 21 pages.

* cited by examiner

SOUND COLLECTION AND PLAYBACK APPARATUS, AND RECORDING MEDIUM

TECHNICAL FIELD

The present invention relates to a sound collection and playback apparatus. For example, the present invention relates to a sound collection and playback apparatus which generates signals having bidirectionality in a plurality of mutually perpendicular directions and an omnidirectional signal, from sound signals obtained by sound collection by means of a plurality of nondirectional microphones, and reproduce a sound field. The bidirectional components of different directions are used, for example, as an X, Y, Z components of an ambisonic B-format, and the omnidirectional component is used, for example, as a W component of the ambisonic B-format. The present invention also relates to a program for causing a computer to execute processes in sound collection and playback in the sound collection and playback apparatus, and a recording medium in which such a program is recorded.

BACKGROUND ART

Along with spread of virtual reality (VR) technology, needs of a sound collection and playback apparatus handling VR images are increasing. A sound collection and playback apparatus is a technology for identifying the direction of sound arrival, and reproducing sound depending on the direction of the sound arrival. Such a sound collection and playback apparatus is used, for example, for reproducing changes in the sound field which occur when the head of the listener is turned. For example, when the listener turns his/her head while watching a sport on a television, the sound produced by the speakers is changed to reflect the changes in the direction of the sound arrival due to the turning. As one of such streophonic sound technology, ambisonics is known.

In ambisonics, special microphones called ambisonics microphones are generally used to obtain signals of ambisonic A-format, which are then converted to signals of ambisonic B-format (Non-patent reference 1). Examples of ambisonic microphones are TetraMic (Core Sound), SPS200 (SoundField), and the like.

PRIOR ART REFERENCES

Non-Patent References

[Non-patent reference 1] Ryouichi Nishimura "Ambisonics", The Journal of the Institute of Image Information and Television Engineers, Vol. 68, No. 8, p. 616-620 (2014).

[Non-patent reference 2] Barry D. Van Veen, et al. "Beamforming: A versatile Approach to Spatial Filtering" IEEE ASSP MAGAZINE APRIL 1988

SUMMARY OF THE INVENTION

Problems to be Solved by the Invention

To implement the method of the Non-patent reference 1, special microphones which are expensive are needed. Another problem is that there is no freedom in the placement of the microphones.

An object of the present invention is to provide a sound collection and playback apparatus capable of generating signals having bidirectionality in a plurality of mutually perpendicular directions, and an omnidirectional signal, without using special microphones, and without excessive restrictions with regard to the placement of the microphones.

Means for Solving the Problem

A sound collection and playback apparatus of one aspect of the present invention includes a microphone array, a processing circuit, and a sound output device, wherein said microphone array includes first and second microphones placed on, among first, second and third axes which are mutually perpendicular, said first axis, a third microphone placed at a position on a plane formed by said first and second axes, and at a position other than on said first axis, and a fourth microphone placed on said third axis, and at a position other than on a plane formed by said first and second axes, said processing circuit generates signals having bidirectionality in first, second, and third directions which are mutually perpendicular, and an omnidirectional signal, based on signals obtained by sound collection by means of said first to fourth microphones, generates a drive signal from said signals having bidirectionality and said omnidirectional signal having been generated, and drives said sound output device using the drive signal.

A sound collection and playback apparatus of another aspect of the present invention includes a microphone array, a processing circuit, and a sound output device, wherein said microphone array includes:

first and second microphones placed on, among first and second axes which extend on a horizontal plane and are mutually perpendicular, said first axis, and a third microphone placed on said horizontal plane, and at a position other than on said first axis, said processing circuit generates signals having bidirectionality in first and second directions which are parallel with said horizontal plane and are mutually perpendicular, and an omnidirectional signal, based on signals obtained by sound collection by means of said first, second and third microphones, generates a drive signal from said signals having bidirectionality, and said omnidirectional signal, having been generated, and drives said sound output device by means of said drive signal.

Effect of the Invention

According to the present invention, it is possible to generate signals having bidirectionality in a plurality of mutually perpendicular directions and an omnidirectional signal, without using special microphones and without excessive restrictions with regard to the placement of the microphones.

MODE FOR CARRYING OUT THE INVENTION

First Embodiment

Figure 1:
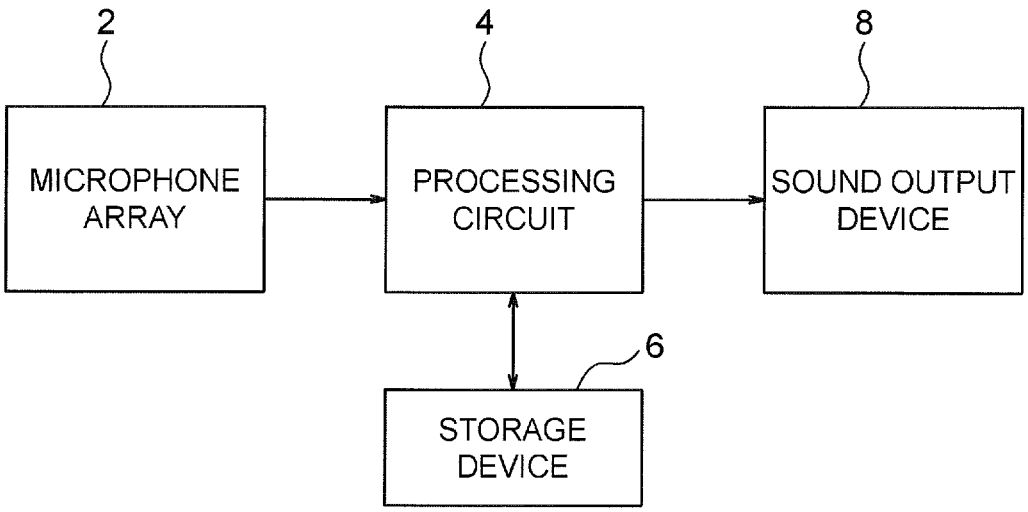
FIG. 1 is a block diagram showing an example of a configuration of a sound collection and playback apparatus of a first embodiment of the present invention.

FIG. 1 shows an example of a configuration of a sound collection and playback apparatus of a first embodiment of the present invention.

The illustrated sound collection and playback apparatus includes a microphone array 2, a processing circuit 4, a storage device 6, and a sound output device 8.

Figure 2:
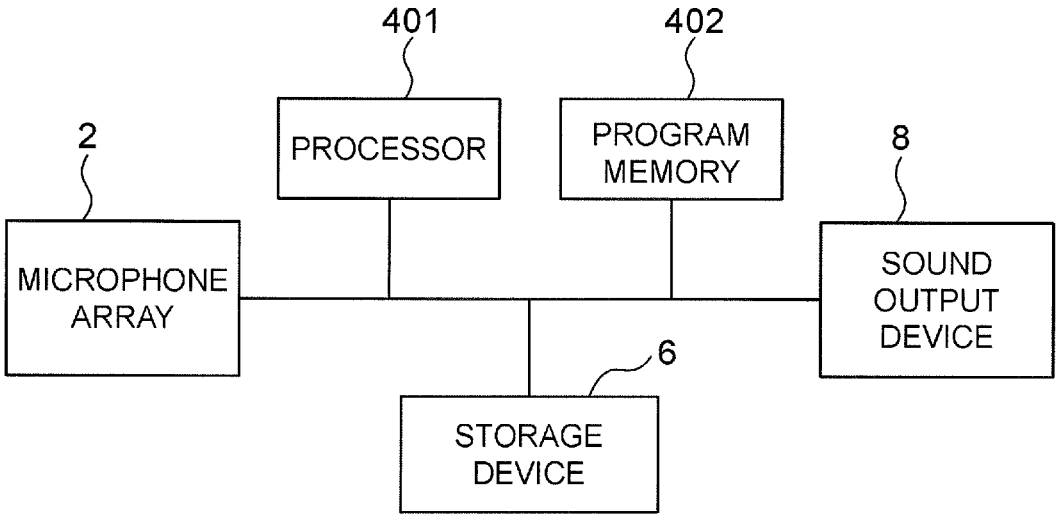
FIG. 2 is a bock diagram showing a configuration of a sound collection and playback apparatus for a case in which a processing circuit in FIG. 1 is implemented by software.

The functions of the processing circuit 4 in FIG. 1 can be implemented by hardware or software. An example of a configuration of the sound collection and playback apparatus implemented by software is shown in FIG. 2. A processor 401 and a program memory 402 in FIG. 2 form the processing circuit 4 in FIG. 1. The processor 401 serves as the processing circuit 4 in FIG. 1 by operating according a program stored in the program memory 402.

The storage device 6 may be formed of an HDD (hard disk drive), an SSD (sold state drive), or the like, and may be connected directly, or via a network, to the processing circuit 4.

In FIG. 1, sound is collected by the microphone array 2, and sound signals (acquired signals) outputted from the microphone array 2 are inputted to the processing circuit 4. The processing circuit 4 performs signal processing for converting the inputted acquired signals into a plurality of bidirectional signals, and an omnidirectional signal. The bidirectional signals are signals having bidirectionality in mutually perpendicular directions. The processing circuit 4 records the signals (converted signals) generated by the conversion. At the time of playback, the processing circuit 4 generates, from the recorded converted signals, sound signals (drive signals) suitable for the sound output device 8, and supplies the drive signals to the sound output device 8. Responsive to the supplied drive signals, the sound output device 8 outputs sound.

Figure 3:
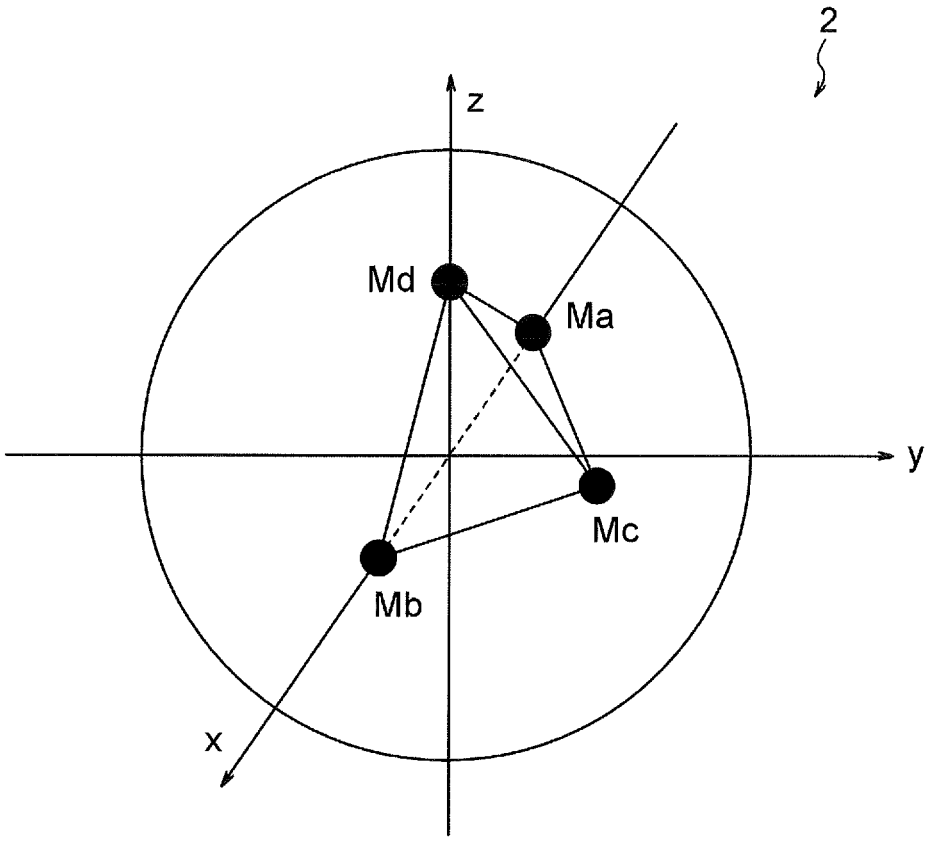
FIG. 3 is a diagram showing an example of placement of a plurality of microphones constituting a microphone array used in the sound collection and playback apparatus of the first embodiment.

FIG. 3 shows an example of placement of a plurality of microphones constituting the microphone array 2 in the present embodiment. In the illustrated example, the microphone array 2 comprises four nondirectional microphones Ma to Md. These microphones Ma to Md are placed in the following manner.

First, in a space in which the microphones Ma to Md are placed, three mutually perpendicular axes are defined as an x axis, a y axis, and a z axis. These three axes form an xyz coordinate system having its origin at the intersection of the three axes.

Among these axes, the x axis and the y axis are horizontal axes, and the z axis is a vertical axis.

Two of the microphones, Ma and Mb, are placed on either of the horizontal axes, e.g. the x axis. One of the microphones, Mc, is placed on a horizontal plane (xy plane) formed by the x axis and the y axis, and at a position other than on the x axis. Furthermore, one microphone, Md, is placed on the z axis, and at a position other than on the xy plane.

Figure 4:
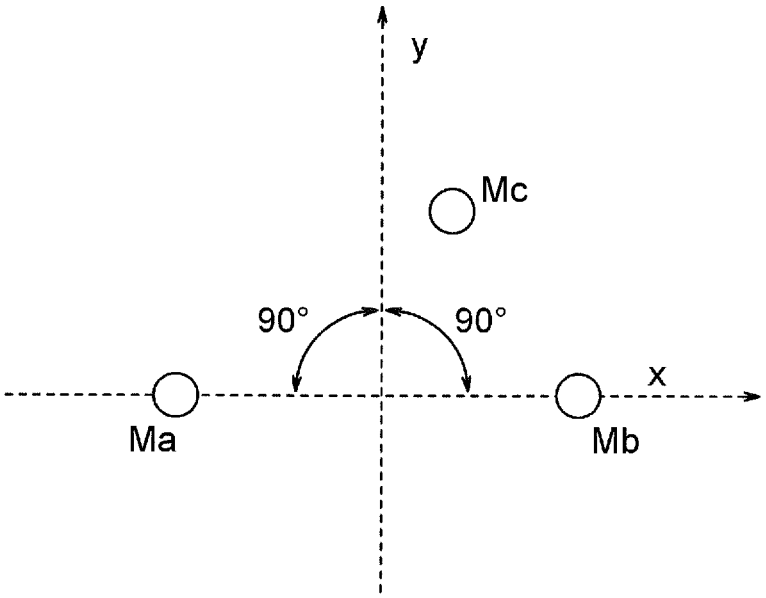
FIG. 4 is a diagram showing microphones used for generating a signal having bidirectionality in the x axis direction and a signal having bidirectionality in the y axis direction, among the microphones shown in FIG. 3.
Figure 5:
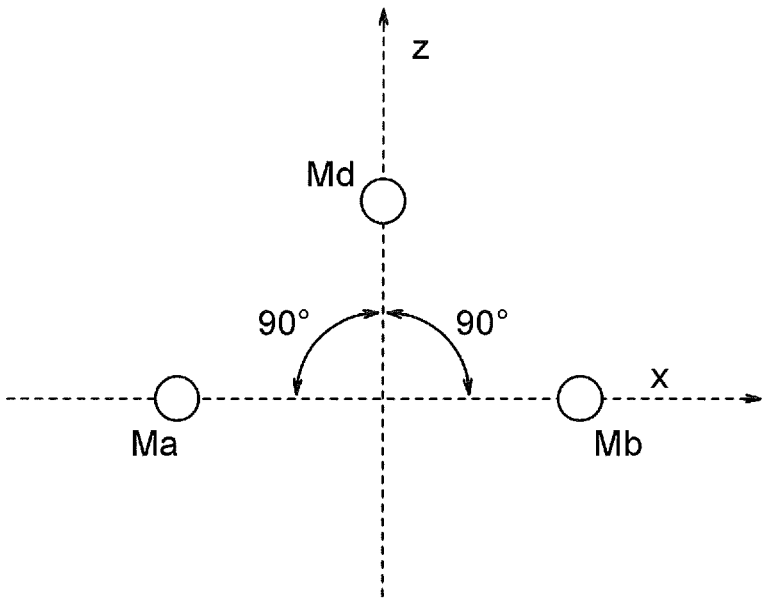
FIG. 5 is a diagram showing a microphone used for generating a signal having bidirectionality in the z axis direction, among the microphones shown in FIG. 3.

As a result of such placement of the microphones Ma to Md, the microphones Ma, Mb and Mc are positioned on the xy plane as shown in FIG. 4, and the microphones Ma, Mb and Md are positioned on an xz plane as shown in FIG. 5.

Sound is collected by the microphones Ma to Md placed in the manner described above, and sound signals (acquired signals) Aa to Ad obtained by sound collection are inputted to the processing circuit 4. Based on the inputted acquired signals Aa to Ad, the processing circuit 4 generates the signals having bidirectionality in mutually different directions and the omnidirectional signal. These signals may be called converted signals, for the sake of convenience. The signals having bidirectionality in mutually different directions are used, for example, as an X signal, a Y signal and a Z signal of the ambisonic B-format, and the omnidirectional signal is used, for example, as a W signal of the ambisonic B-format.

Figure 6:
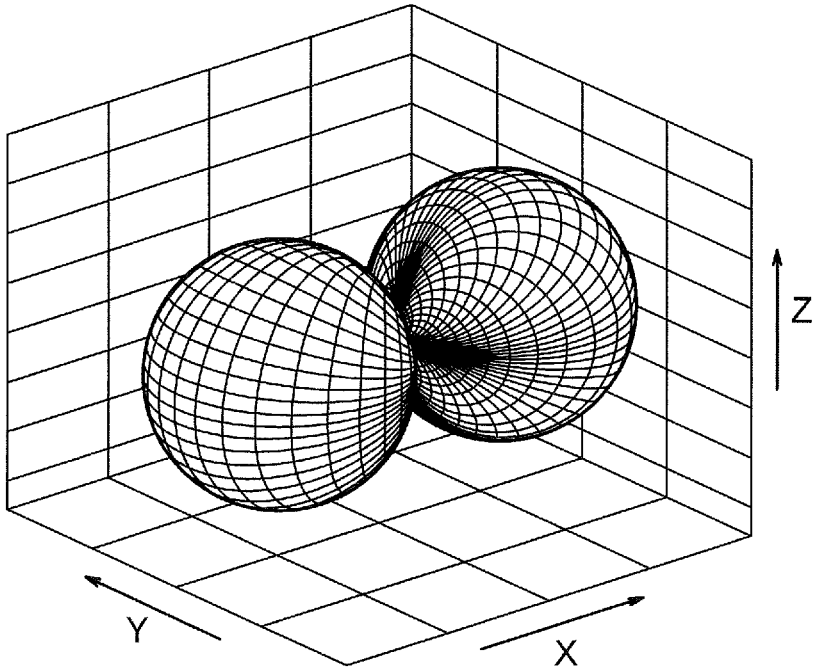
FIG. 6 is a diagram showing bidirectionality possessed by the X signal of the ambisonic B-format.
Figure 7:
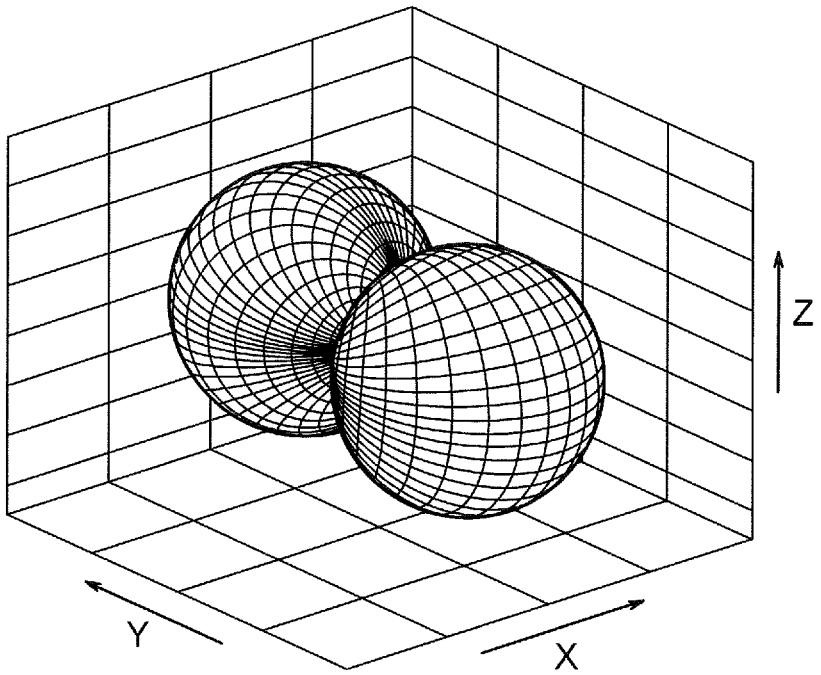
FIG. 7 is a diagram showing bidirectionality possessed by the Y signal of the ambisonic B-format.
Figure 8:
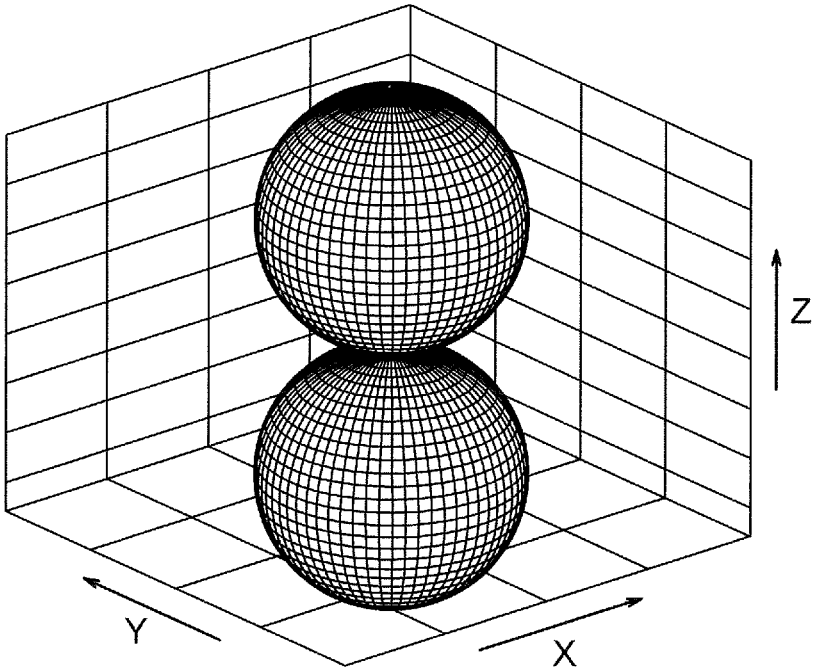
FIG. 8 is a diagram showing bidirectionality possessed by the Z signal of the ambisonic B-format.
Figure 9:
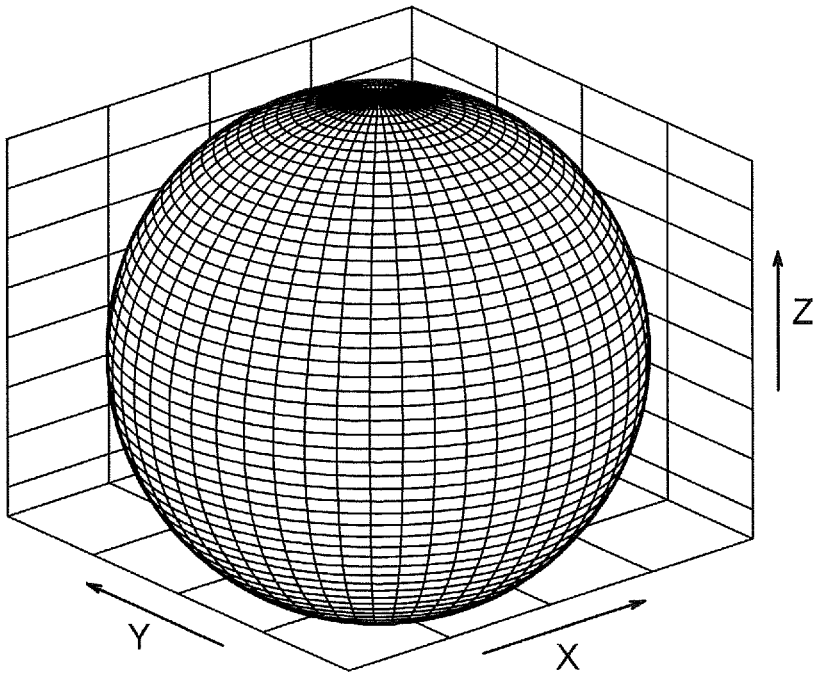
FIG. 9 is a diagram showing omnidirectionality possessed by the W signal of the ambisonic B-format.

FIG. 6, FIG. 7 and FIG. 8 show the bidirectionality of the X signal, the Y signal and the Z signal of the ambisonic B-format. FIG. 9 shows the omnidirectionality of the W signal of the ambisonic B-format.

Figure 10:
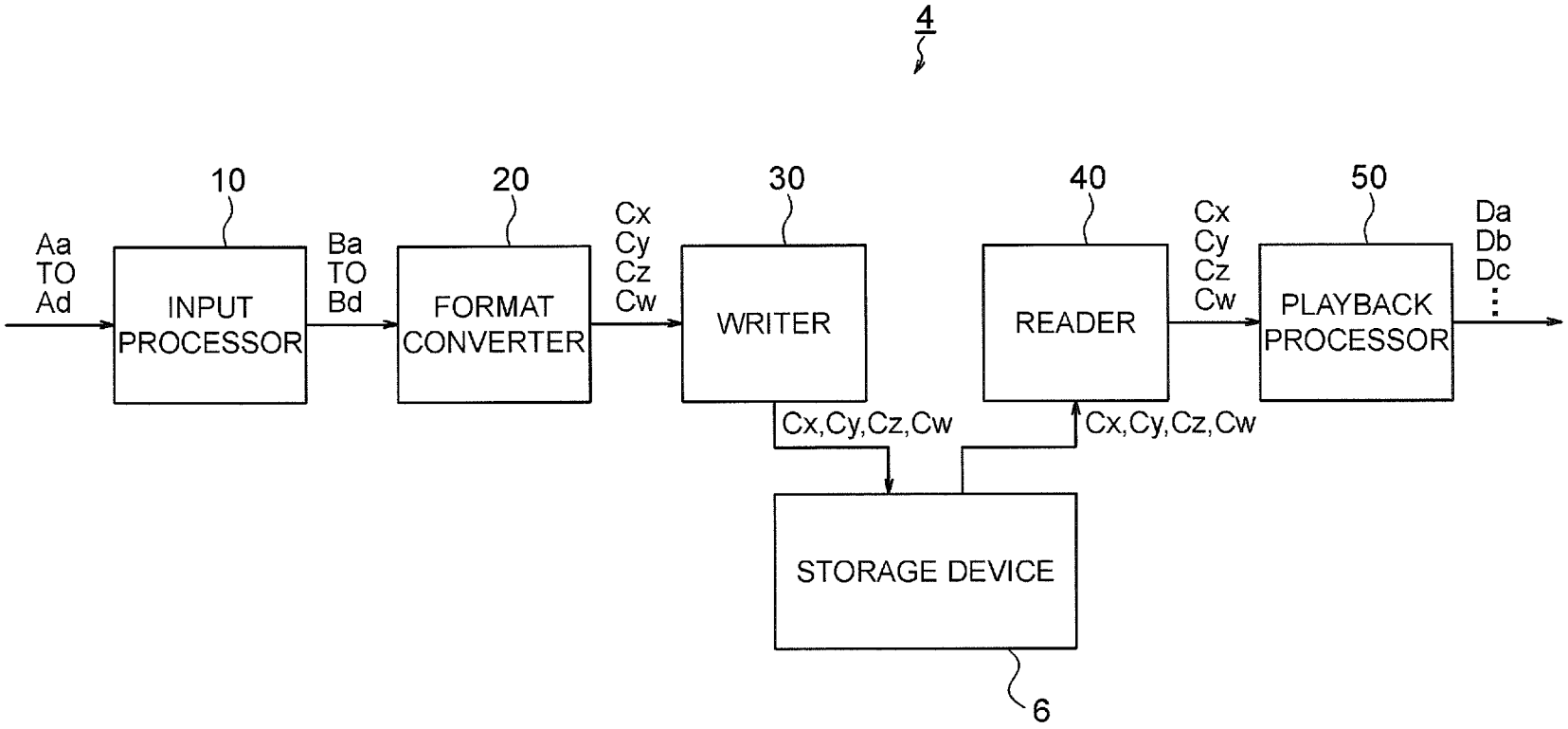
FIG. 10 is a block diagram showing an example of a configuration of the processing circuit in FIG. 1.

As shown in FIG. 10, the processing circuit 4 in FIG. 1 includes an input processor 10, a format converter 20, a writer 30, a reader 40, and a playback processor 50.

The input processor 10 receives the sound signals Aa to Ad from the microphones Ma to Md of the microphone array 2, performs processes such as amplification and A/D conversion, and generates output signals (input-processed signals) Ba to Bd respectively corresponding to the signals Aa to Ad.

The signal Aa and the signal Ba are both sound signals obtained by sound collection by means of the microphone Ma. Similarly, the signal Ab and the signal Bb are both sound signals obtained by sound collection by means of the microphone Mb. Similarly, the signal Ac and the signal Bc are both sound signals obtained by sound collection by means of the microphone Mc. Similarly, the signal Ad and the signal Bd are both sound signals obtained by sound collection by means of the microphone Md.

Figure 11:
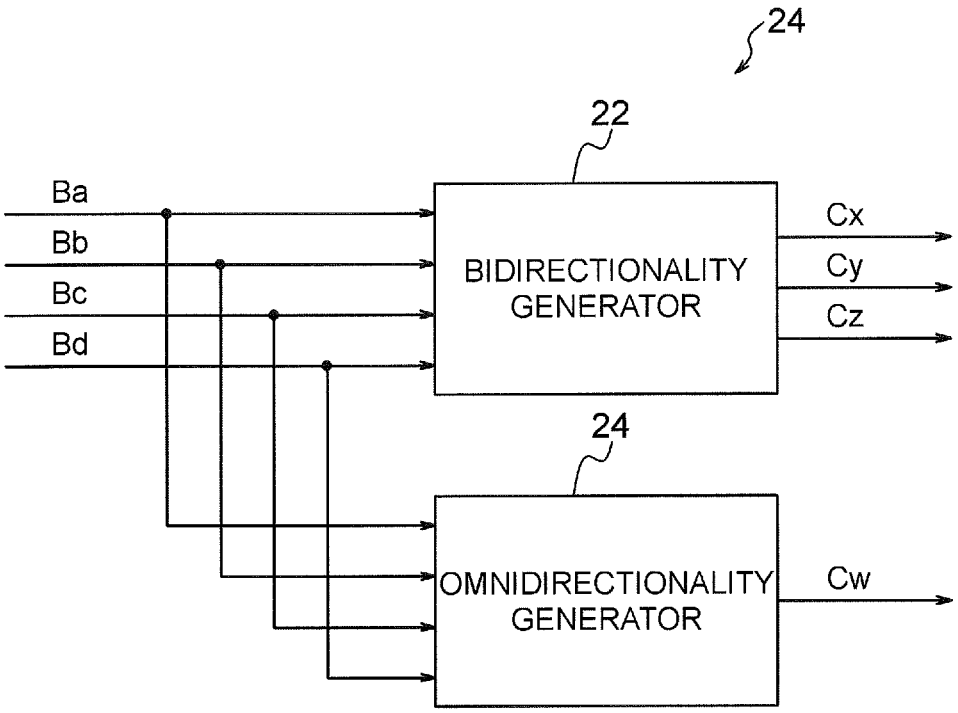
FIG. 11 is a block diagram showing an example of a configuration of a format converter in FIG. 10.

As shown in FIG. 11, the format converter 20 includes a bidirectionality generator 22, and an omnidirectionality generator 24.

The bidirectionality generator 22 generates the signal (X signal) Cx having bidirectionality in the x axis direction, the signal (Y signal) Cy having bidirectionality in the y axis direction, and the signal (Z signal) Cz having bidirectionality in the z axis direction, using the signals Ba to Bd obtained by sound collection by means of the microphones Ma to Md.

Figure 12:
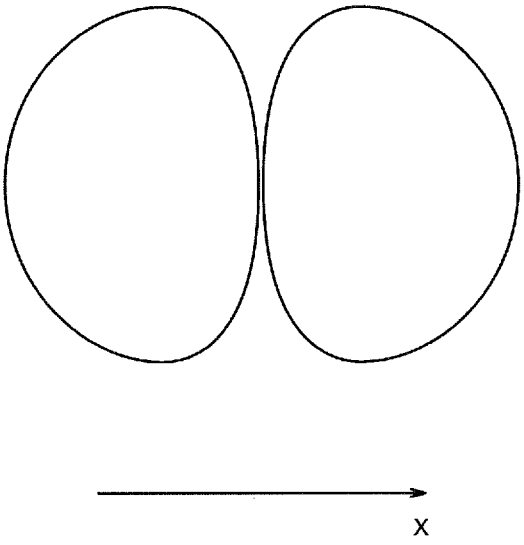
FIG. 12 is a diagram showing directionality of an X signal generated in the format converter in FIG. 11.
Figure 13:
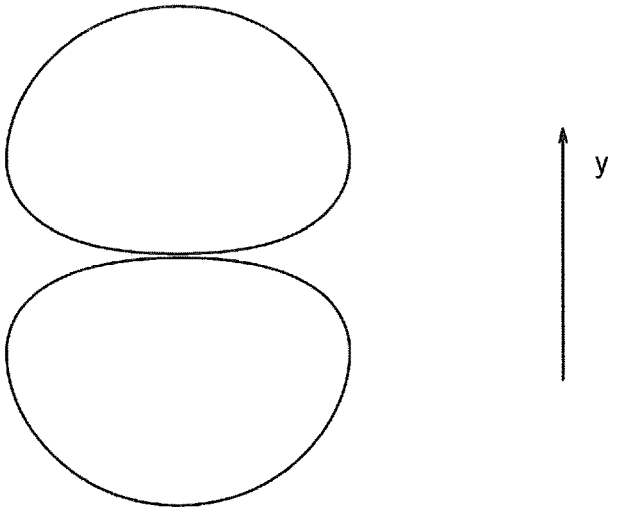
FIG. 13 is a diagram showing directionality of a Y signal generated in the format converter in FIG. 11.
Figure 14:
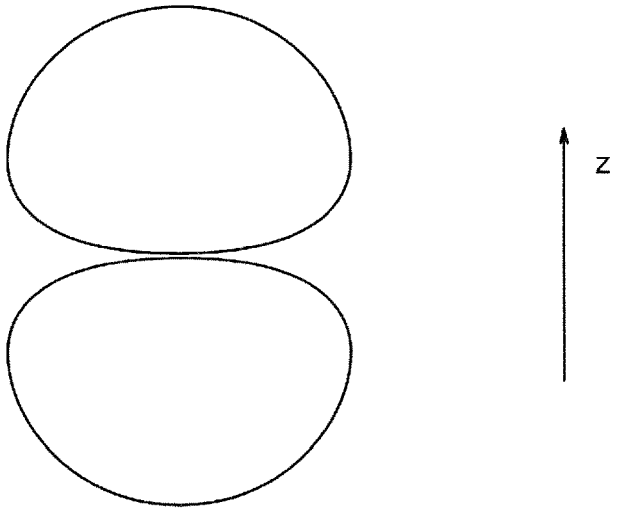
FIG. 14 is a diagram showing directionality of a Z signal generated in the format converter in FIG. 11.

Specifically, it generates the X signal (FIG. 12) Cx having bidirectionality in the x axis direction and the Y signal (FIG. 13) Cy having bidirectionality in the y axis direction, using the signals Ba, Bb and Bc obtained by sound collection by means of the microphones Ma, Mb and Mc positioned on the xy plane as shown in FIG. 4, and generates the Z signal (FIG. 14) Cz having bidirectionality in the z axis direction, using the signals Ba, Bb and Bd obtained by sound collection by means of the microphones Ma, Mb and Md positioned on the xz plane as shown in FIG. 5.

Incidentally, the X signal Cx having bidirectionality in the x axis direction may be generated, using the signals Ba, Bb and Bd obtained by sound collection by means of the microphones Ma, Mb and Md positioned on the xz plane.

What is required is that a signal having bidirectionality in a direction of a certain axis is generated using acquired signals obtained by sound collection by means of microphones positioned on a plane including the above-mentioned certain axis.

As has been described, according to the present embodiment, a signal having bidirectionality in a direction of an axis positioned in a plane is generated from signals obtained by sound collection by means of three microphones positioned on the above-mentioned plane.

Incidentally, if the microphones are placed at vertexes of a regular tetrahedron, for example, it is not possible to generate signals having bidirectionality in mutually perpendicular directions.

The generation of the X signal Cx, the Y signal Cy and the Z signal Cz can be performed by beamforming. Specifically, an output of a beamformer when the direction of the beam is oriented to the direction of the x axis in the beamforming is used as the X signal Cx, an output of a beamformer when the direction of the beam is oriented to the direction of the y axis in the beamforming is used as the Y signal Cy, and an output of a beamformer when the direction of the beam is oriented to the direction of the z axis in the beamforming is used as the Z signal Cz.

The X signal Cx, the Y signal Cy and the Z signal Cz obtained in the manner described above are respectively used as the X signal, the Y signal and the Z signal of the ambisonic B-format.

The beamforming process may be performed by any algorithm. For example, the method described in Non-patent reference 2 may be used. Non-patent reference 2 shows that the coefficients of the filter used in the beamforming may be determined according to the equation (3.2) on page 12. In the equation (3.2) in Non-patent reference 2, $r_d$ indicates desired directionality, and bidirectionality is represented by:

$$r_d = \cos(\theta)$$

In the above equation, θ is an angle with respect to the direction of the principal axis of the bidirectionality.

By using three or more microphones, the directions of bidirectionality can be set freely in a plane in which the three microphones are placed. For example, it is possible to generate bidirectional signals having, as the directions of their principal axes, two directions (e.g., x direction and y direction) which are within the above-mentioned plane and mutually perpendicular. If the number of the microphones is two, it is possible to generate a signal having bidirectionality, but only in one direction.

Figure 15:
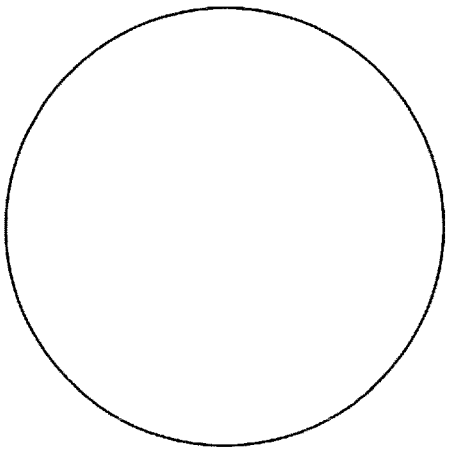
FIG. 15 is a diagram showing directionality of a W signal generated in the format converter in FIG. 11.

The omnidirectionality generator 24 generates the omnidirectional signal (W signal) Cw (FIG. 15), using one of the signals Ba to Bd obtained by sound collection by means of the four microphones Ma to Md, or using a combination of two or more of the signals Ba to Bd.

When one of the signals Ba to Bd is used, it can be used as the W signal Cw, without change. When a combination of two or more of the signals Ba to Bd is used, for example, an output of the beamformer when omnidirectionality is generated by a beamforming process using the combination of the signals can be used as the W signal Cw.

The W signal Cw obtained in the manner described above is used as the W signal of the ambisonic B-format.

The writer records the X signal Cx, the Y signal Cy, the Z signal Cz and the W signal Cw generated by the format converter 20, in the storage device 6.

The storage device 6 stores the recorded signals.

At the time of the playback for realizing streophonic sound, the recorded signals Cx, Cy, Cz and Cw are read, and sound signals (drive signals) suitable for the sound output device 8 are generated.

Specifically, the reader 40 reads the signals Cx, Cy, Cz and Cw stored in the storage device 6.

The playback processor 50 generates the signals (drive signals) Da, Db, Dc, . . . of the format suitable for the sound output device 8, based on the signals Cx, Cy, Cz and Cw having been read, and outputs the generated signals. Conversion to the drive signals Da, Db, Dc, . . . can be performed, for example, by a well-known playback method of the ambisonic B-format, described in Non-patent reference 1. In this case, the signals Cx, Cy, Cz and Cw are respectively used as the X signal, the Y signal, the Z signal and the W signal of the ambisonic B-format.

For example, depending on placement of a plurality of speakers constituting the sound output device 8, the signal used for driving each speaker is generated. For example, the drive signals are generated by multiplying the X, Y, Z, and W signals Cx, Cy, Cz and Cw of the ambisonic B-format, by coefficients, and performing addition, and the generated signals are used for driving the respective speakers.

Procedures of the processes for generating and storing the X signal, the Y signal, the Z signal and the W signal (converted signals) Cx, Cy, Cz, Cw at the time of sound collection, and generating the drive signals from the stored converted signals at the time of playback will now be described with reference to the flowcharts of FIGS. 16(*a*) and 16(*b*).

Figure 16A:
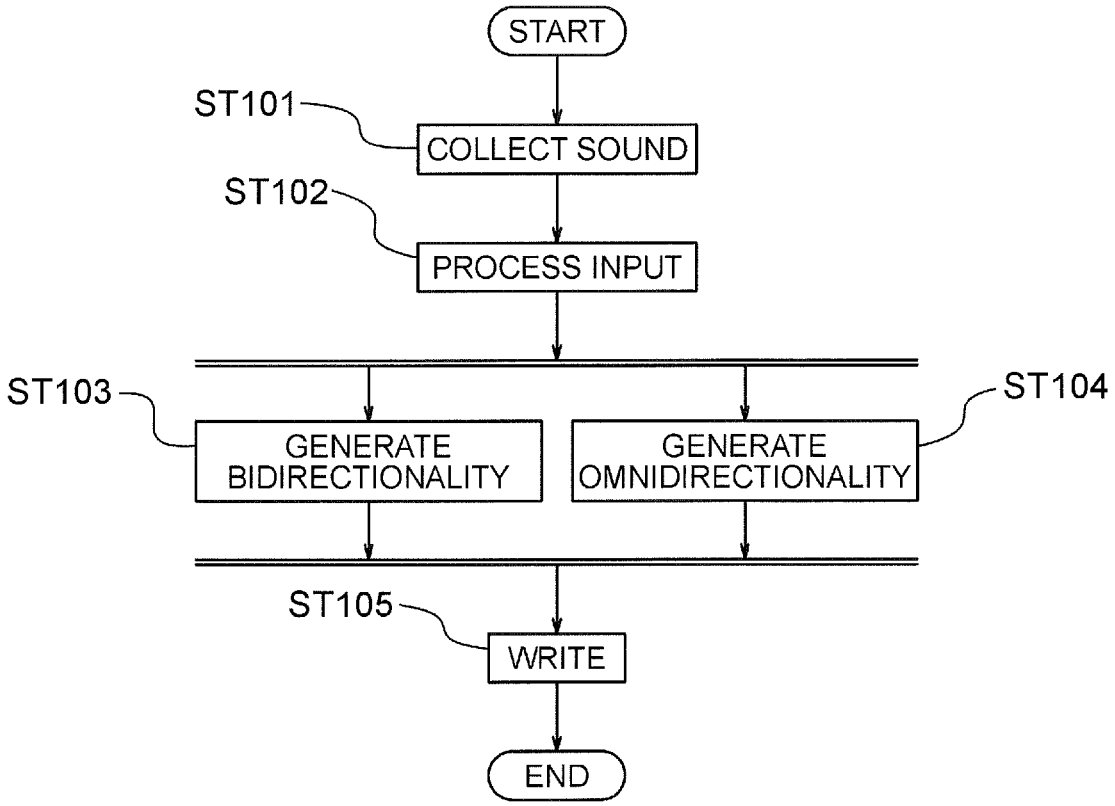
FIGS. 16(*a*) and 16(*b*) are flowcharts showing procedures of processes in the processing circuit in the sound collection and playback apparatus of the first embodiment.
Figure 16B:
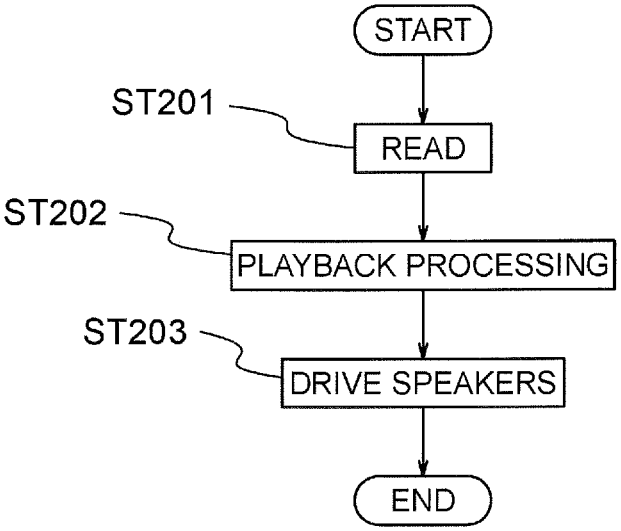

At the time of recording, the processes shown in FIG. 16(*a*) are performed.

In step ST101, sound collection is performed by means of the microphones Ma to Md, and the acquired signals Aa to Ad are supplied to the processing circuit 4.

Next, in step ST102, the processing circuit 4 performs input-processing on the acquired signals Aa to Ad to generate the input-processed signals Ba to Bd.

Next, the processes in steps ST103 and ST104 can be performed in parallel with each other.

In step ST103, the processing circuit 4 generates the X signal Cx, the Y signal Cy and the Z signal Cz from the signals Ba to Bd.

In step ST104, the processing circuit 4 generates the W signal Cw from one of the signals Ba to Bd, or from a combination of two or more of the signals Ba to Bd.

After steps ST103 and ST104, the process of step ST105 is performed.

In step ST105, the processing circuit 4 writes the signals (converted signals) Cx, Cy, Cz and Cw generated in steps ST103 and ST104, in the storage device 6, and causes it to store the written signals.

At the time of playback, the processes in FIG. 16(*b*) are performed.

In step ST201, the processing circuit 4 reads the converted signals Cx, Cy, Cz and Cw stored in the storage device 6.

In step ST202, the processing circuit 4 generates the drive signals Da, Db, Dc, . . . using the converted signals Cx, Cy, Cz and Cw having been read.

In step ST203, the processing circuit 4 drives the speakers of the sound output device 8, using the drive signals Da, Db, Dc, . . . having been generated.

As has been described, according to the first embodiment, the x axis and the y axis are horizontal axes, the z axis is a vertical axis, the microphones Ma and Mb are placed on the x axis, the microphone Mc is placed on the xy plane, and at a position other than on the x axis, the microphone Md is placed on the z axis, and signals having bidirectionality in the x axis direction, the y axis direction and the z axis direction are generated. However, the x axis, the y axis and the z axis mentioned above are interchangeable. What is required is that: the first and second microphones Ma and Mb are placed on, among first, second and third mutually perpendicular axes (x axis, y axis and z axis), the first axis (e.g., x axis); the third microphone Mc is placed on a plane (xy plane) formed by the first axis and the second axis (e.g., y axis), and at a position other than on the first axis (x axis); and the fourth microphone Md is placed on the third axis (z axis).

Also, it is sufficient if a signal having bidirectionality in the first direction (x direction) and a signal having bidirectionality in the second direction (y direction) are generated using the sound signals obtained by sound collection by means of the first, second and third microphones Ma, Mb and Mc, and a signal having bidirectionality in the third direction (z direction) is generated using the sound signals obtained by sound collection by means of the first, second and fourth microphones Ma, Mb and Md.

Also, the axes used as references for the placement of a plurality of microphones, and the directions of the generated bidirectionality need not accord with each other. What is required is that, if the axes used as references in the placement of the microphones are defined as first, second and third axes (f, g and h axes), and the directions of the generated bidirectionality are defined as first, second and third directions (x, y and z directions), the placement of the microphones and the microphones used for generating bidirectionality of respective directions satisfy the following relations:

(a1) First and second microphones (Ma and Mb) are placed on a first axis (e.g., f axis) among three mutually perpendicular axes (f, g and h axes); a third microphone (Mc) is placed on a plane (fg plane) formed by the first axis and a second axis (e.g., f and g axes), and at a position other than on the first axis (f axis); and a fourth microphone (Md) is placed on a third axis (e.g., h axis), and at a position other than on the plane (fg plane) formed by the first and second axes.

(a2) The signals having bidirectionality in the first, second and third mutually perpendicular directions (e.g., x, y and z directions) are generated using the sound signals obtained by sound collection by means of the first to fourth microphones (Ma to Md).

More specifically;

(a2a) the signals having bidirectionality in the first and second directions (e.g., x and y directions) are generated using the sound signals obtained by sound collection by means of the first, second and third microphones (Ma, Mb and Mc), and (a2b) the signal having bidirectionality in the third direction (z direction) is generated using the sound signals obtained by sound collection by means of the first, second and fourth microphones (Ma, Mb and Md).

For example, one (e.g., h axis) of the first, second and third axes (f, g and h axes) is a vertical axis, and one (e.g., z direction) of the first, second and third directions (x, y and z directions) is a vertical direction.

In the first embodiment described, the third axis (h axis) is a vertical axis, and the third direction (z direction) is a vertical direction. Accordingly, the first and second axes (f and g axes) are axes extending on a horizontal plane, and the first and second directions (x direction and y direction) are directions parallel with the horizontal plane.

According to the present embodiment, by the use of a combination of inexpensive nondirectional microphones, signals having bidirectionality in three mutually perpendicular directions can be obtained. Also, it is sufficient if the placement of the microphones satisfies the above-mentioned conditions, and there is no restriction on the distances between the microphones. As a result, the microphone array may be in the form of a compact microphone set, and can be mounted on a small-sized device (mobile phone, smartphone, wearable device, or the like).

Second Embodiment

The second embodiment differs from the first embodiment in the configuration of the microphone array and the configuration of the processing circuit. That is, in the second embodiment, a microphone array 2*b* shown in FIG. 17 is used in place of the microphone array 2 in the first embodiment, and a processing circuit 4*b* shown in FIG. 18 is used in place of the processing circuit 4 in the first embodiment.

Figure 17:
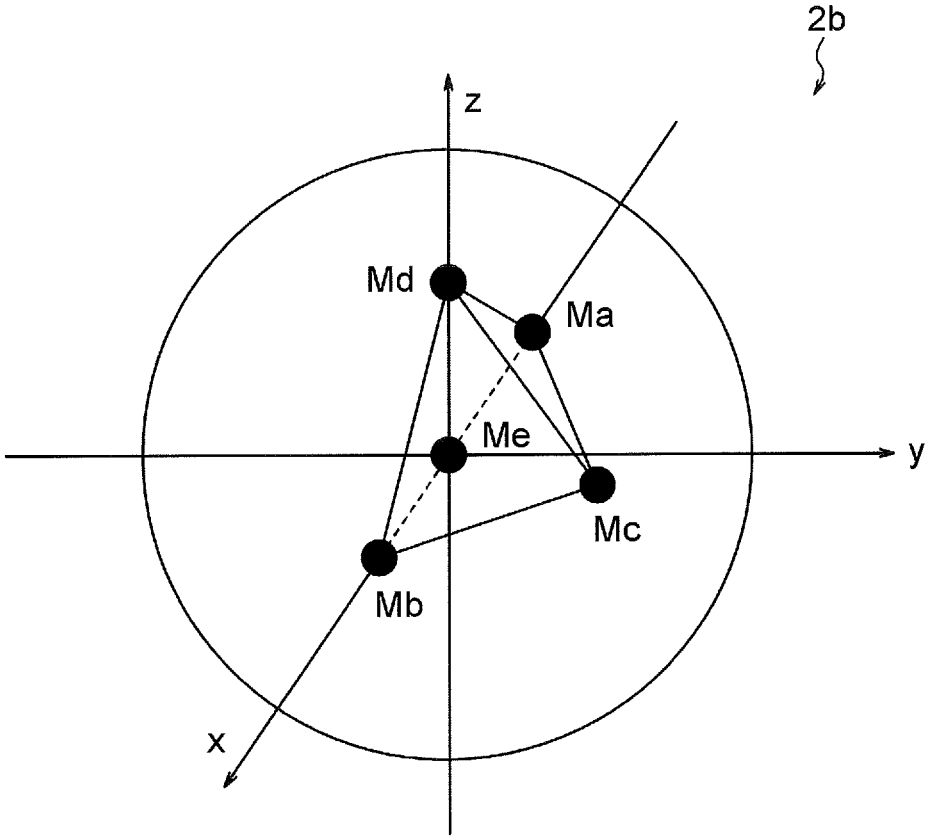
FIG. 17 is a diagram showing placement of a plurality of microphones constituting a microphone array in a sound collection and playback apparatus of a second embodiment of the present invention.
Figure 18:
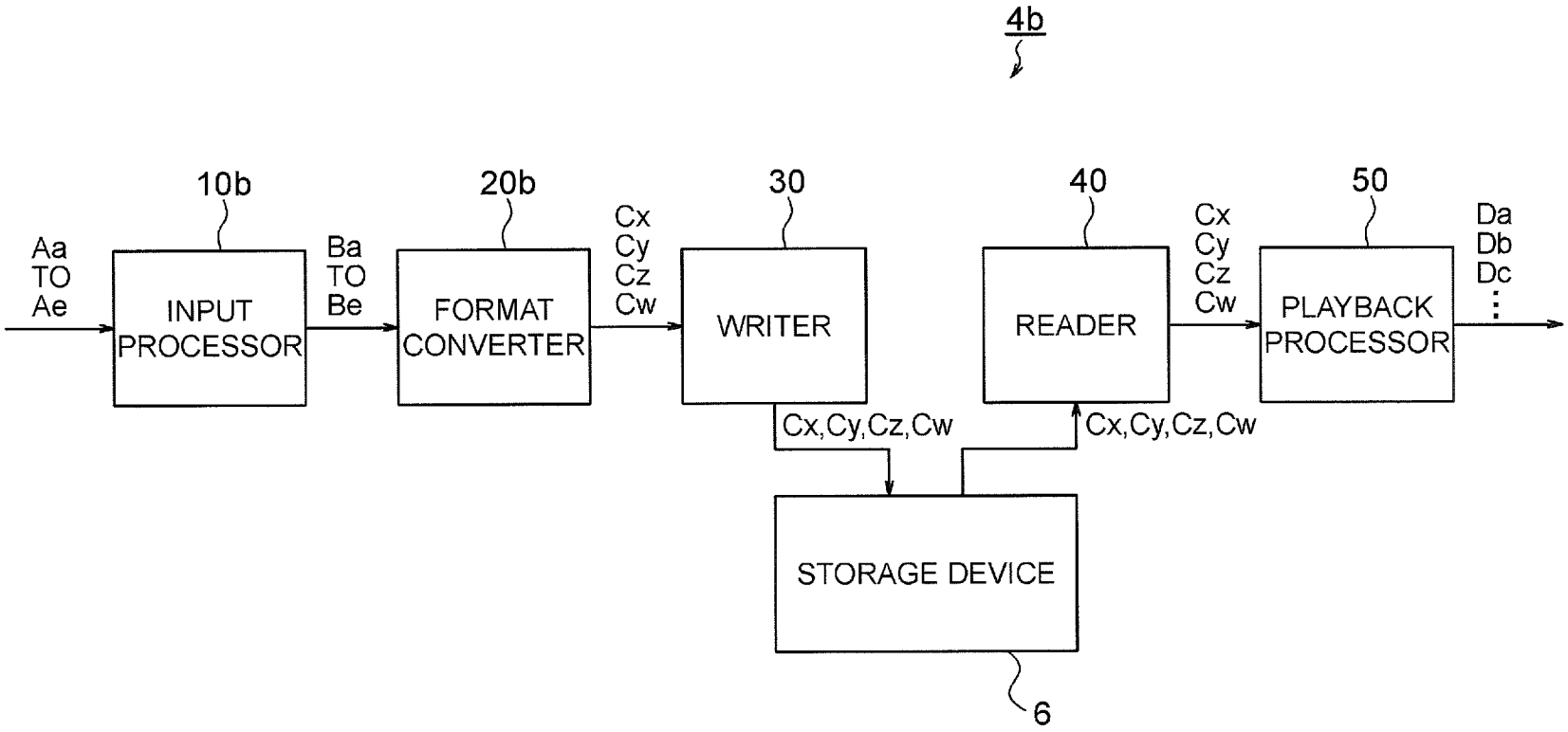
FIG. 18 is a block diagram showing an example of a configuration of a processing circuit in the sound collection and playback apparatus of the second embodiment of the present invention.

FIG. 17 shows placement of microphones constituting the microphone array 2*b* of a sound collection and playback apparatus of the second embodiment, and FIG. 18 shows the processing circuit 4*b* of the sound collection and playback apparatus of the second embodiment.

In FIG. 17 and FIG. 18, reference characters identical to those in FIG. 1 and FIG. 3 denote identical or similar parts or components.

As shown in FIG. 17, the microphone array 2*b* in the second embodiment comprises five microphones Ma to Me. Of those, the microphones Ma to Md are placed in the same manner as in the first embodiment.

The microphone Me is placed at an intersection of the x axis, the y axis and the z axis, i.e., the origin of the xyz coordinate system, and is a nondirectional microphone, as are the microphones Ma to Md.

As shown in FIG. 18, the processing circuit 4*b* used in the second embodiment includes an input processor 10*b*, a format converter 20*b*, a writer 30, a reader 40, and a playback processor 50.

The writer 30, the reader 40 and the playback processor 50 are identical or similar to those described in the first embodiment.

The input processor 10*b* receives acquired signals Aa to Ae from the microphones Ma to Me of the microphone array 2*b*, performs processes such as amplification and A/D conversion, and generates input-processed signals Ba to Be respectively corresponding to the signals Aa to Ae, as a result of the above-mentioned processes, and outputs the generated signals. The input-processed signals Ba to Be can also be said to be signals obtained by sound collection by means of the microphones Ma to Me, as in the first embodiment.

Figure 19:
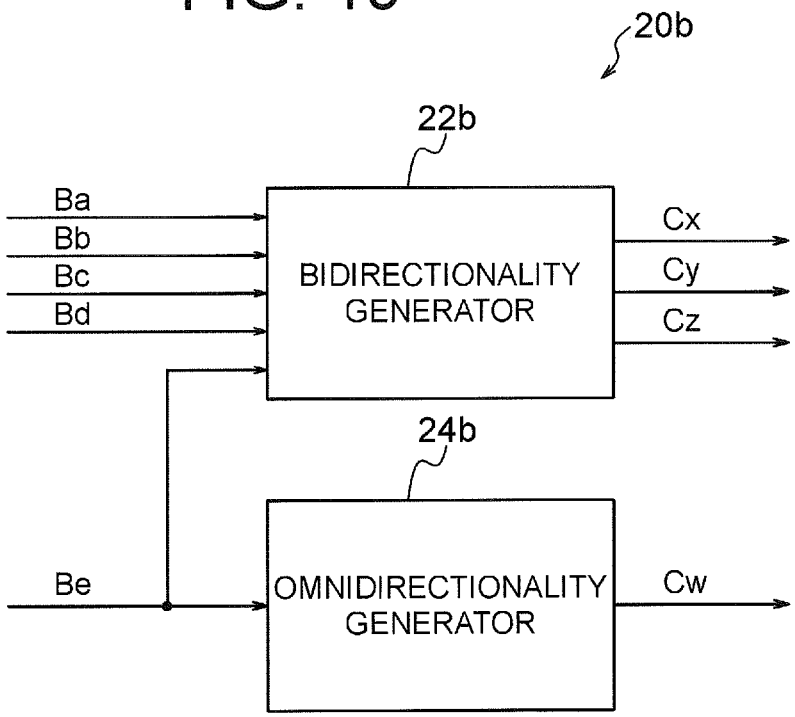
FIG. 19 is a block diagram showing an example of a configuration of a format converter in FIG. 18.

As shown in FIG. 19, the format converter 20*b* includes a bidirectionality generator 22*b* and an omnidirectionality generator 24*b*.

The bidirectionality generator 22*b* generates the X signal Cx (FIG. 12) and the Y signal Cy (FIG. 13) using the signals Ba, Bb, Bc and Be obtained by sound collection by means of the microphones Ma, Mb, Mc and Me (FIG. 17), and generates the Z signal Cz (FIG. 14) using the signals Ba, Bb, Bd and Be obtained by sound collection by means of the microphones Ma, Mb, Md and Me (FIG. 17).

Because the microphone Me placed at the origin is additionally used to generate the bidirectional signals, the directivity of the generated signals can be made sharper.

The omnidirectionality generator 24*b* outputs the signal Be obtained by sound collection by means of the microphone Me as the W signal Cw.

Because the signal Be obtained by sound collection by means of the microphone Me placed at the origin is used as the W signal Cw without change, it is possible to avoid signal degradation due to processes such as beamforming.

The writer 30*b* records the X signal Cx, the Y signal Cy, the Z signal Cz and the W signal Cw generated in the format converter 20*b*, in the storage device 6.

The storage device 6 stores the X signal Cx, the Y signal Cy, the Z signal Cz and the W signal Cw having been recorded.

The playback process of the recorded sound is the same as in the first embodiment.

In the second embodiment, as in the first embodiment, the above-mentioned x axis, y axis and z axis are interchangeable. What is required is that: the first and second microphones Ma and Mb are placed on, among first, second and third mutually perpendicular axes (x axis, y axis, and z axis), the first axis (e.g., x axis); the third microphone Mc is placed on a plane (xy plane) formed by the first axis and the second axis (e.g., y axis), and at a position other than on the first axis (x axis); the fourth microphone Md is placed on the third axis (z axis); and the fifth microphone Me is placed at the intersection of the first, second and third axes.

Also, it is sufficient if a signal having bidirectionality in the first direction (x direction) and a signal having bidirectionality in the second direction (y direction) are generated using the sound signals obtained by sound collection by means of the first, second, third and fifth microphones Ma, Mb, Mc and Me, and a signal having bidirectionality in the third direction (z direction) is generated using the sound signals obtained by sound collection by means of the first, second, fourth and fifth microphones Ma, Mb, Md and Me.

Also, as in the first embodiment, the axes used as references for the placement of a plurality of microphones, and the directions of generated bidirectionality need not accord with each other. What is required is that, if the axes used as references in the placement of the microphones are defined as first, second and third axes (f, g and h axes), and the directions of generated bidirectionality are defined as first, second and third directions (x, y and z directions), the placement of the microphones and the microphones used for the generating the bidirectionality of respective directions satisfy the following relations:

(b1) First and second microphones (Ma and Mb) are placed on a first axis (e.g., f axis) among three mutually perpendicular axes (f, g and h axes); a third microphone (Mc) is placed on a plane (fg plane) formed by the first axis and a second axis (e.g., f and g axes), and at a position other than on the first axis (f axis); a fourth microphone (Md) is placed on a third axis (e.g., h axis), and at a position other than on the plane (fg plane) formed by the first and second axes; and a fifth microphone (Me) is placed at the intersection of the above-mentioned first, second and third axes.

(b2) The signals having bidirectionality in the first, second and third mutually perpendicular directions (e.g., x, y and z directions) are generated using the sound signals obtained by sound collection by means of the first to fifth microphones (Ma to Me).

More specifically;

(b2a) the signals having bidirectionality in the first and second directions (e.g., x and y directions) are generated using the sound signals obtained by sound collection by means of the first, second, third and fifth microphones (Ma, Mb, Mc and Me), and (b2b) the signal having bidirectionality in the third direction (z direction) is generated using the sound signals obtained by sound collection by means of the first, second, fourth and fifth microphones (Ma, Mb, Md and Me).

One (e.g., h axis) of the above-mentioned first, second and third axes (f, g and h axes) is a vertical axis, and one (e.g., z direction) of the above-mentioned first, second and third directions (x, y and z directions) is a vertical direction.

In the above-described second embodiment, as in the first embodiment, the third axis (h axis) is a vertical axis and the third direction (z direction) is a vertical direction. Accordingly, the first and second axes (f and g axes) are axes extending on a horizontal plane, and the first and second directions (x direction, and y direction) are directions parallel with the horizontal plane.

Third Embodiment

The third embodiment differs from the first embodiment in the configuration of the microphone array and the configuration of the processing circuit. That is, in the third embodiment, a microphone array 2*c* shown in FIG. 20 is used in place of the microphone array 2 in the first embodiment, and a processing circuit 4*c* shown in FIG. 21 is used in place of the processing circuit 4 in the first embodiment.

Figure 20:
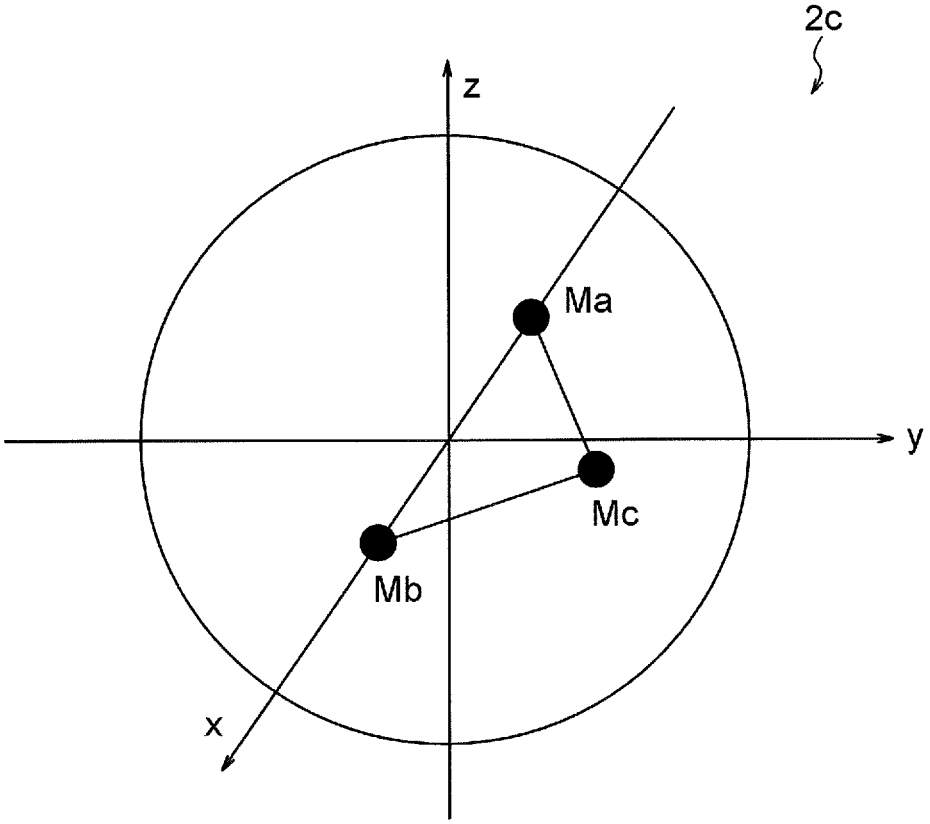
FIG. 20 is a diagram showing placement of a plurality of microphones constituting a microphone array in a sound collection and playback apparatus of a third embodiment of the present invention.
Figure 21:
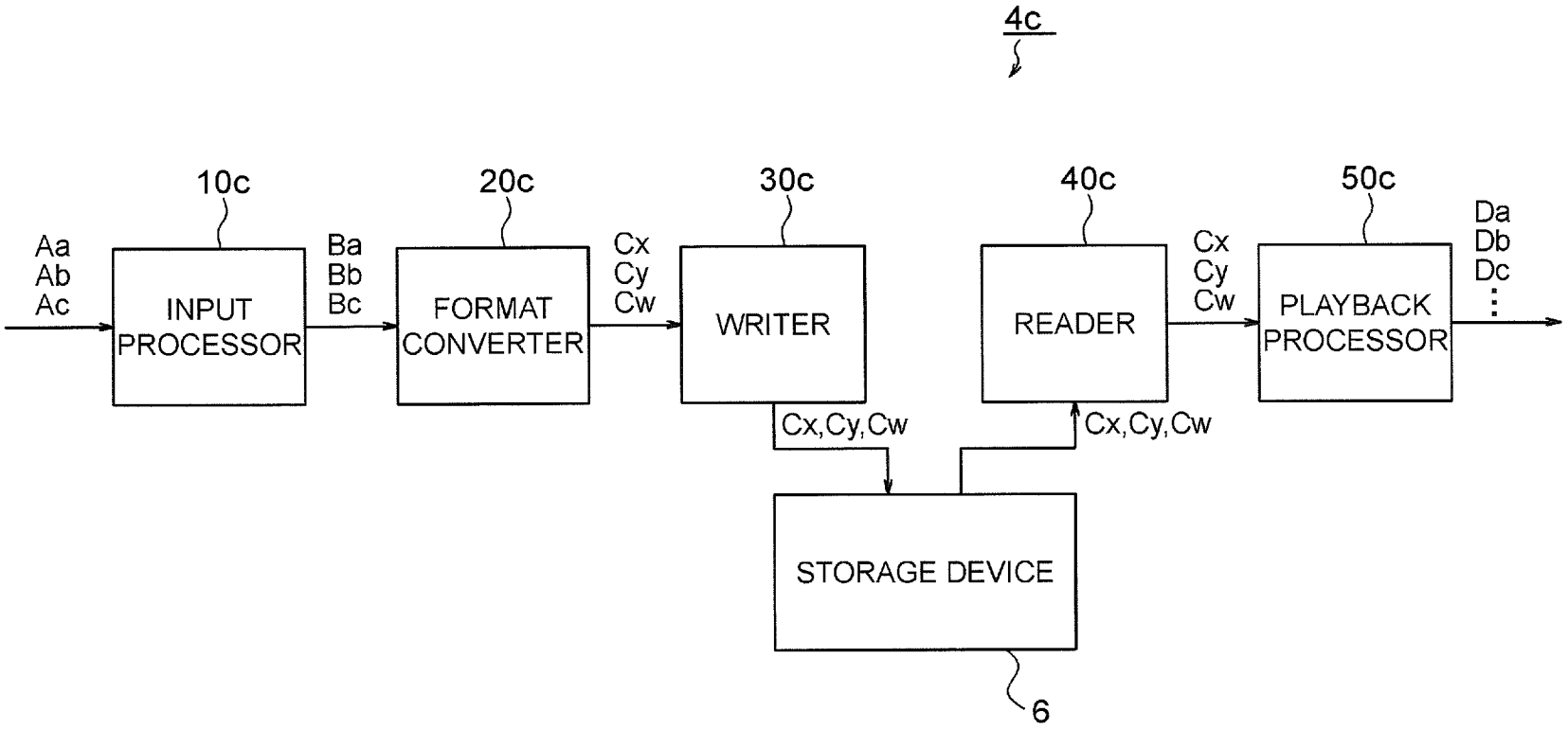
FIG. 21 is a block diagram showing an example of a configuration of a processing circuit in the sound collection and playback apparatus of the third embodiment.

FIG. 20 shows placement of microphones constituting the microphone array 2*c* of a sound collection and playback apparatus of the third embodiment, and FIG. 21 shows the processing circuit 4*c* of the sound collection and playback apparatus of the third embodiment.

In FIG. 20 and FIG. 21, reference characters identical to those in FIG. 1 and FIG. 3 denote identical or similar parts or components.

As shown in FIG. 20, the microphone array 2*c* in the third embodiment comprises three microphones Ma, Mb and Mc, and the microphone Md in the first embodiment is not used.

Also, in the third embodiment, the x axis and the y axis are axes extending horizontally, so that the plane formed by the x axis and the y axis is a horizontal plane. The microphones Ma, Mb and Mc are placed in the same manner as in the first embodiment. That is, the two microphones Ma and Mb are placed on the x axis (FIG. 20). Also, the microphone Mc is placed on the xy plane, and at a position other than on the x axis.

As shown in FIG. 21, the processing circuit 4*c* used in the third embodiment includes an input processor 10*c*, a format converter 20*c*, a writer 30*c*, a reader 40*c*, and a playback processor 50*c*.

The input processor 10*c* receives acquired signals Aa to Ac from the microphones Ma to Mc of the microphone array 2*c*, performs processes such as amplification and A/D conversion, generates input-processed signals Ba to Bc respectively corresponding to the signals Aa to Ac as a result of the above-mentioned processes, and outputs the generated signals.

Figure 22:
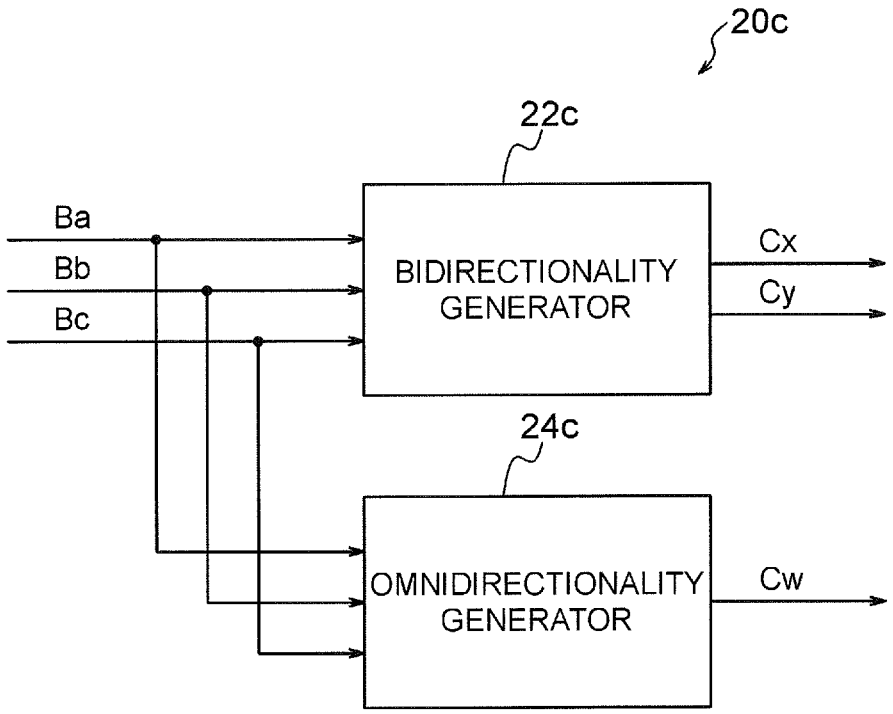
FIG. 22 is a block diagram showing an example of a configuration of a format converter in FIG. 20.

As shown in FIG. 22, the format converter 20*c* includes a bidirectionality generator 22*c* and an omnidirectionality generator 24*c*.

The bidirectionality generator 22*c* generates the X signal Cx (FIG. 12) and the Y signal Cy (FIG. 13) using the signals Ba, Bb, and Bc obtained by sound collection by means of the microphones Ma, Mb and Mc (FIG. 20).

The omnidirectionality generator 24*c* generates the W signal Cw (FIG. 15) using one of the signals Ba, Bb and Bc obtained by sound collection by means of the three microphones Ma, Mb and Mc, or using a combination of two or more of the signals Ba, Bb and Bc.

When one of the signals Ba, Bb and Bc is used, it can be used as the W signal Cw without change. When a combination of two or more of the signals Ba, Bb and Bc is used, for example, an output of the beamformer when beamforming process is performed using the combination of the signals can be used as the W signal Cw.

In the third embodiment, the Z signal Cz is not generated.

The writer 30*c* records the X signal Cx, the Y signal Cy and the W signal Cw generated by the format converter 20*c*, in the storage device 6.

The storage device 6 stores the recorded signals.

At the time of playback for realizing streophonic sound, the recorded signals Cx, Cy and Cw are read, and sound signals (drive signals) suitable for the sound output device 8 are generated.

Specifically, the reader 40 reads the signals Cx, Cy and Cw stored in the storage device 6.

The playback processor 50 converts the read signals Cx, Cy and Cw into the signals (drive signals) Da, Db, Dc, . . . of the format suitable for the sound output device 8, and outputs the converted signals. The conversion into the drive signals Da, Db, Dc, . . . can be performed, for example, by a well-known ambisonic B-format playback method described in Non-patent reference 1. In this case, the signals Cx, Cy and Cw are used respectively as the X signal, the Y signal and the W signal of the ambisonic B-format. Calculation is made on the assumption that the Z signal of the ambisonic B-format is zero.

For example, depending on placement of a plurality of speakers constituting the sound output device 8, the signal used for driving each speaker is generated. For example, the drive signals are generating by multiplying the X, Y and W signals Cx, Cy and Cw of the ambisonic B-format, by coefficients, and performing addition, and the generated signals are used for driving the respective speakers.

As has been described, in the third embodiment, the signal having vertical bidirectionality is not generated. As a result, the playback sound does not enable vertical localization, although it enables localization in the azimuth direction. Some applications do not require vertical localization. In such a case the configuration of the third embodiment can be used. The third embodiment is advantageous in that the microphone array is relatively small.

As has been described, according to the third embodiment, the x axis and the y axis are horizontal axes, the microphones Ma and Mb are placed on the x axis, the microphone Mc is placed on the xy plane, and at a position other than on the x axis, and signals having bidirectionality in the x axis direction and the y axis direction are generated. However, the x axis and the y axis mentioned above are interchangeable. What is required is that: the first and second microphones Ma and Mb are placed on, among a first and second mutually perpendicular axes (x axis and y axis), the first axis (e.g., x axis), the third microphone Mc is placed on a plane (xy plane) formed by the first axis and the second axis (e.g., y axis), and at a position other than on the first axis (x axis). Here, the x axis and the y axis are axes extending horizontally.

Also, it is sufficient if a signal having bidirectionality in the first direction (x direction) and a signal having bidirectionality in the second direction (y direction) are generated using the sound signals obtained by sound collection by means of the first, second and third microphones Ma, Mb and Mc.

Also, as in the first and second embodiments, the axes used as references for the placement of a plurality of microphones, and the directions of generated bidirectionality need not accord with each other. What is required is that, if the axes used as references in the placement of the microphones are defined as first and second axes (f axis and g axis), and the directions of the generated bidirectionality are defined as first and second directions (x direction and y direction), the placement of the microphones and the microphones used for generating bidirectionality of respective directions satisfy the following relations:

(c1) First and second microphones (Ma, Mb) are placed on a first axis (e.g., f axis) among two mutually perpendicular axes (f axis and g axis) which extend on a horizontal plane; and a third microphone (Mc) is placed on the above-mentioned horizontal plane (fg plane) and at a position other than on the first axis (f axis).

(c2) The signals having bidirectionality in the first and second mutually perpendicular directions (e.g., x direction and y direction) which are on the horizontal plane (fg plane), and are parallel with the above-mentioned horizontal plane are generated using the sound signals obtained by sound collection by means of the first, second and third microphones (Ma, Mb and Mc).

Also, in the third embodiment, the microphone array may include a microphone (Me) placed at the intersection of two axes, as in the second embodiment.

In this case, the sound signal obtained by sound collection by means of the microphone (Me) placed at the above-mentioned intersection is also used for generating bidirectionality in the first and second directions.

Also, the sound signal obtained by sound collection by means of the microphone (Me) placed at the above-mentioned intersection may be used as the W signal Cw without change, as in the second embodiment.

Fourth Embodiment

In the first embodiment, the X signal Cx, the Y signal Cy, the Z signal Cz and the W signal Cw are generated at the time of sound collection, and stored until the time of playback. But the generation of these signals may be performed at the time of playback.

In such a case, the signals Ba to Bd obtained by sound collection may be recorded, and, at the time of playback, the X signal Cx, the Y signal Cy, the Z signal Cz and the W signal Cw are generated from the read signals Ba to Bd, and the drive signals Da, Db, Dc, . . . are generated from the signals Cx, Cy, Cz and Cw.

Figure 23:
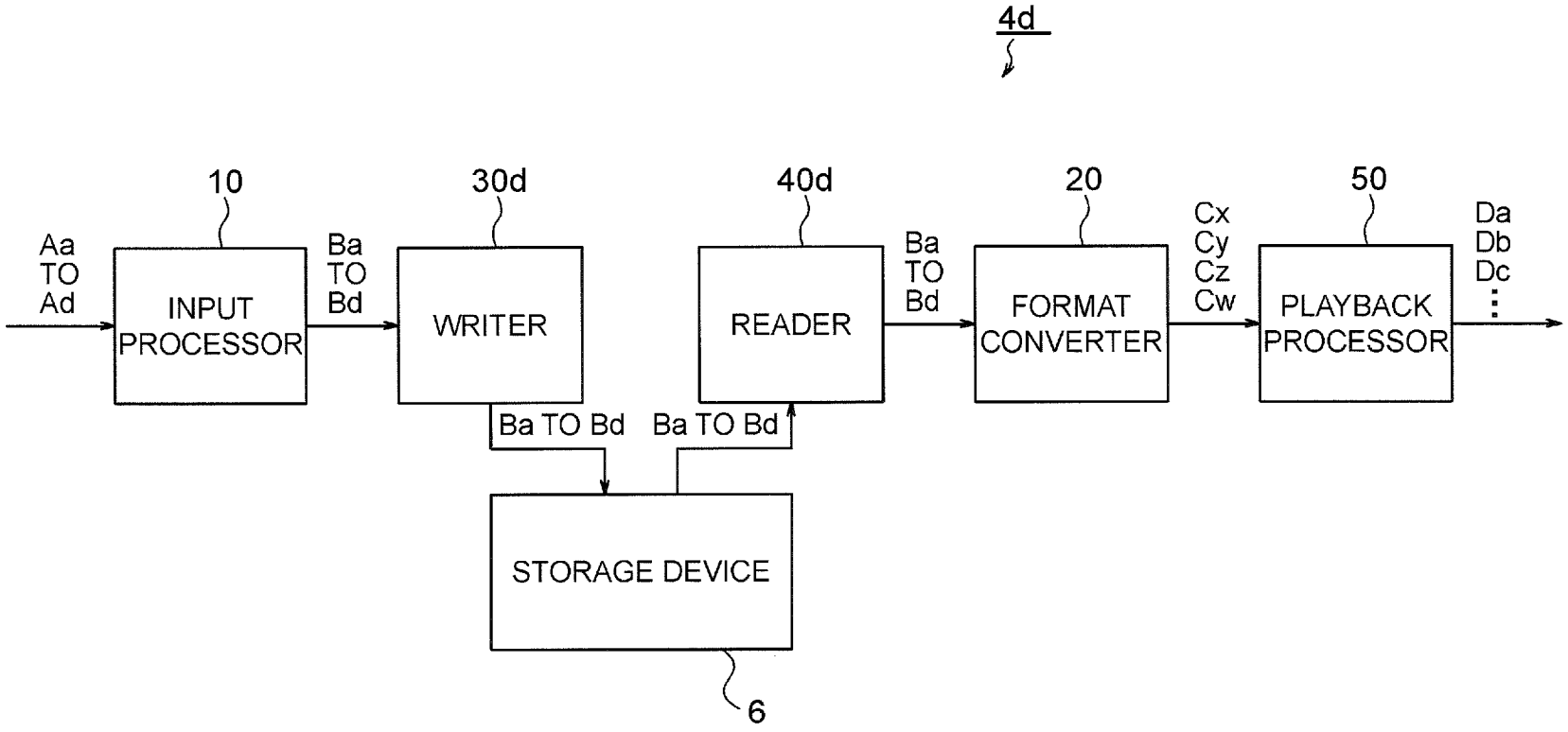
FIG. 23 is a block diagram showing an example of a configuration of a processing circuit in a sound collection and playback apparatus of a fourth embodiment.

In this case, in place of the processing circuit 4 in the first embodiment, a processing circuit 4*d* shown in FIG. 23 is used.

The processing circuit 4*d* shown in FIG. 23 includes an input processor 10, a writer 30*d*, a reader 40*d*, a format converter 20, and a playback processor 50.

In FIG. 23, reference characters identical to those in FIG. 1 denote identical or similar parts or components.

As in the first embodiment, the input processor 10 receives the sound signals Aa to Ad from the microphones Ma to Md of the microphone array 2*c*, performs processes such as amplification and A/D conversion, and generates the signals (input-processed signals) Ba to Bd respectively corresponding to the signals Aa to Ad as a result of the above-mentioned processes, and outputs the generated signals.

The writer 30*d* records the sound signals Ba to Bd from the input processor 10, in the storage device 6.

The storage device 6 stores the recorded signals Ba to Bd.

At the time of the playback for realizing streophonic sound, the recorded signals Ba to Bd are read, and used for generating the sound signals (drive signals) suitable for the sound output device 8.

Specifically, the reader 40*d* reads the signals Ba to Bd stored in the storage device 6.

The format converter 20 converts the read signals Ba to Bd into the X signal Cx, the Y signal Cy, the Z signal Cz and the W signal Cw.

The internal configuration of the format converter 20 is identical to that described in the first embodiment.

The playback processor 50 converts the X signal Cx, the Y signal Cy, the Z signal Cz and the W signal Cw into the signals (drive signals) Da, Db, Dc, . . . of the format suitable for the sound output device 8, and outputs the drive signals.

Procedures for this case will now be described with reference to the flowcharts of FIGS. 24(*a*) and 24(*b*).

Figure 24A:
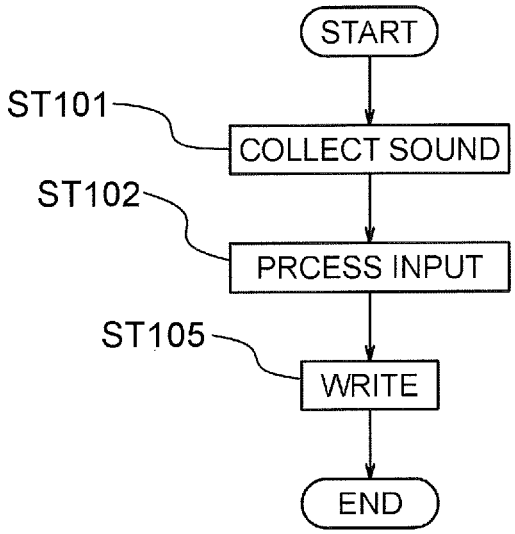
FIGS. 24(*a*) and 24(*b*) are flowcharts showing procedures of processes in the processing circuit in the sound collection and playback apparatus of the fourth embodiment.
Figure 24B:
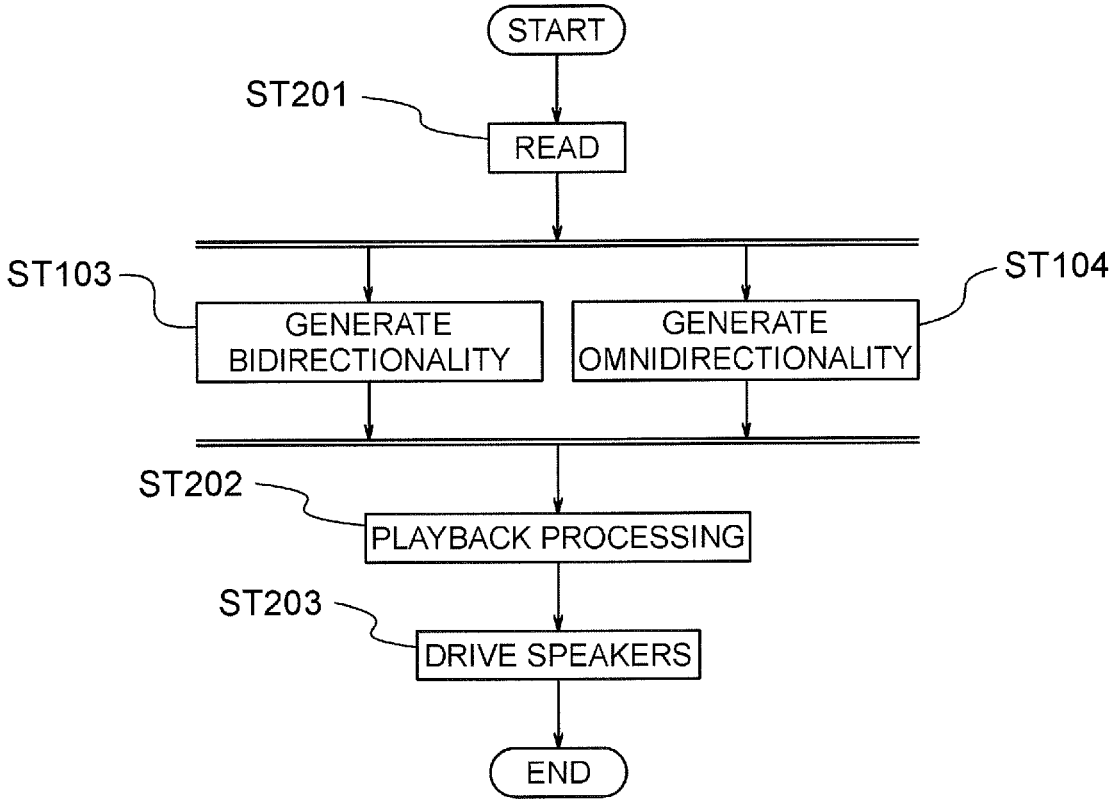

At the time of recording, the processes shown in FIG. 24(*a*) are performed.

In step ST101, sound collection is performed by means of the microphones Ma to Md, and the acquired signals Aa to Ad are supplied to the processing circuit 4*d*.

In step ST102, the processing circuit 4*d* performs input-processing on the acquired signals Aa to Ad to generate the input-processed signals Ba to Bd.

In step ST105, the processing circuit 4*d* writes the input-processed signals Ba to Bd in the storage device 6, and causes it to store the written signals.

At the time of playback, the processes shown in FIG. 24(*b*) are performed.

In step ST201, the processing circuit 4*d* reads the signals Ba to Bd stored in the storage device 6.

After step ST201, the processes of step ST103 and step ST104 are performed.

In step ST103, the processing circuit 4*d* generates the X signal Cx, the Y signal Cy and the Z signal Cz from the signals Ba to Bd.

In step ST104, the processing circuit 4*d* generates the W signal Cw from one of the signals Ba to Bd, or from a combination of two or more of the signals Ba to Bd.

After steps ST103 to ST104, the process of step ST202 is performed.

In step ST202, the processing circuit 4*d* generates the drive signals Da, Db, Dc, . . . using the signals Cx, Cy, Cz and Cw generated in steps ST103 and ST104.

In step ST203, the processing circuit 4*d* drives the speakers of the sound output device 8 using the drive signals Da, Db, Dc, . . . having been generated.

So far, the configuration in which the conversion to the X signal Cx, the Y signal Cy, the Z signal Cz and the W signal Cw is performed at the time of playback is described as a variation to the first embodiment. Similar variation may be applied to the second and third embodiments.

It has been explained that the processing circuit of the first embodiment can be implemented by software, that is, by a programmed computer, with reference to FIG. 2. The processing circuits of the second, third, and fourth embodiments may also be implemented by software, i.e., by a programmed computer. Accordingly, a program for causing a computer to execute part or the entirety of the configuration in the above-described sound collection and playback apparatus, and a recording medium in which the above-mentioned program is stored also form part of the present invention.

REFERENCE CHARACTERS

2: microphone array; 4, 4*b*, 4*c*: processing circuit; 6: storage device; 8: sound output device; 10, 10*b*, 10*c*: input processor; 20, 20*b*, 20*c*: format converter; 22, 22*b*, 22*c*: bidirectionality generator; 24, 24*b*, 24*c*: omnidirectionality generator; 30, 30*c*, 30*d*: writer; 40, 40*c*, 40*d*: reader; 50, 50*c*: playback processor; 401: processor; 402: program memory.

The invention claimed is:

1. A sound collection and playback apparatus including a microphone array, a processing circuit, and a sound output device, wherein said microphone array includes first and second microphones placed on, among first, second and third axes which are mutually perpendicular, said first axis, a third microphone placed at a position on a plane formed by said first and second axes, and at a position other than on said first axis, and a fourth microphone placed on said third axis, and at a position other than on a plane formed by said first and second axes, said processing circuit generates signals having bidirectionality in first, second, and third directions which are mutually perpendicular, and an omnidirectional signal, based on signals obtained by sound collection by means of said first to fourth microphones, generates a drive signal from said signals having bidirectionality and said omnidirectional signal having been generated, and drives said sound output device using the drive signal, wherein said processing circuit generates said signals having bidirectionality in said first and second directions using sound signals obtained by sound collection by means of said first, second and third microphones, and generates said signal having bidirectionality in said third direction using sound signals obtained by sound collection by said first, second and fourth microphones, wherein said processing circuit generates said signals having bidirectionality by performing beamforming on said signals obtained by sound collection.

2. The sound collection and playback apparatus as set forth in claim 1, wherein said microphone array further includes a fifth microphone placed at an intersection of said first, second and third axes, and said processing circuit generates said signals having bidirectionality in said first, second and third directions using also a sound signal obtained by sound collection by means of said fifth microphone.

3. The sound collection and playback apparatus as set forth in claim 2, wherein said processing circuit outputs the signal obtained by sound collection by means of said fifth microphone as said omnidirectional signal.

4. The sound collection and playback apparatus as set forth in claim 1, wherein one of said first, second and third axes is a vertical axis, and one of said first, second and third directions is a vertical direction.

5. The sound collection and playback apparatus as set forth in claim 4, wherein said third axis is a vertical axis, and said third direction is a vertical direction.

6. The sound collection and playback apparatus as set forth in claim 5, wherein said first direction is a direction of said first axis, and said second direction is a direction of said second axis.

7. The sound collection and playback apparatus as set forth in claim 1, wherein said signals having bidirectionality in said first, second and third directions are used as an X signal, a Y signal, and a Z signal of an ambisonic B-format, and said omnidirectional signal is used as a W signal of the ambisonic B-format.

8. A non-transitory computer-readable recording medium in which a program for causing a computer to execute processes in the sound collection and playback apparatus as set forth in claim 1 is recorded.

9. The sound collection and playback apparatus as set forth in claim 1, wherein a desired directionality is represented by $r_d$ and the bidirectionality is represented by $r_d = \cos(\theta)$.

10. A sound collection and playback apparatus including a microphone array, a processing circuit, and a sound output device, wherein said microphone array includes:

first and second microphones placed on, among first and second axes which extend on a horizontal plane and are mutually perpendicular, said first axis, and a third microphone placed on said horizontal plane, and at a position other than on said first axis, said processing circuit generates signals having bidirectionality in first and second directions which are parallel with said horizontal plane and are mutually perpendicular, and an omnidirectional signal, based on signals obtained by sound collection by means of said first, second and third microphones, generates a drive signal from said signals having bidirectionality, and said omnidirectional signal, having been generated, and drives said sound output device by means of said drive signal, wherein said microphone array further includes a fourth microphone placed at an intersection of said first and second axes, and said processing circuit generates said signals having bidirectionality in said first and second directions using also the sound signal obtained by sound collection by means of said fourth microphone, wherein said processing circuit generates said signals having bidirectionality by performing beamforming on said signals obtained by sound collection.

11. The sound collection and playback apparatus as set forth in claim 10, wherein said processing circuit outputs the signal obtained by sound collection by means of said fourth microphone as said omnidirectional signal.

12. The sound collection and playback apparatus as set forth in claim 10, wherein said first direction is a direction of said first axis, and said second direction is a direction of said second axis.

13. The sound collection and playback apparatus as set forth in claim 10, wherein a desired directionality is represented by $r_d$ and the bidirectionality is represented by $r_d = \cos(\theta)$.

* * * * *